US007229323B2

(12) United States Patent
Robin

(10) Patent No.: US 7,229,323 B2
(45) Date of Patent: Jun. 12, 2007

(54) DEVICE PLUG AND ELECTRONIC INSTRUMENT SOCKET PARTICULARLY FOR USE IN RECHARGING INSTRUMENT BATTERY

(75) Inventor: Brice Robin, La-Chaux-de-Fonds (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 10/546,236

(22) PCT Filed: Feb. 10, 2004

(86) PCT No.: PCT/EP2004/050105

§ 371 (c)(1),
(2), (4) Date: Aug. 22, 2005

(87) PCT Pub. No.: WO2004/075345

PCT Pub. Date: Sep. 2, 2004

(65) Prior Publication Data

US 2006/0178055 A1 Aug. 10, 2006

(30) Foreign Application Priority Data

Feb. 21, 2003 (EP) ..... 03003938

(51) Int. Cl.
*H01R 24/00* (2006.01)

(52) U.S. Cl. ..... 439/660; 439/638

(58) Field of Classification Search ..... 439/660, 439/638, 682; D13/133
See application file for complete search history.

(56) References Cited

U.S. PATENT DOCUMENTS 4,103,483 A 8/1978 Riley
4,118,922 A 10/1978 Ichiyanagi (Continued)

FOREIGN PATENT DOCUMENTS

EP 0 891 012 A2 1/1999

(Continued)

OTHER PUBLICATIONS

International Search Report in corresponding PCT Appliction No. PCT/EP2004/05105 completed Nov. 3, 2004 and mailed Nov. 19, 2004.

*Primary Examiner*—Tho D. Ta
*Assistant Examiner*—Vanessa Girardi
(74) *Attorney, Agent, or Firm*—Griffin & Szipl, P.C.

(57) ABSTRACT

A device is described for establishing an electrical connection between a portable electronic instrument and an external device, the portable electronic instrument comprising a casing provided with a socket in which a plurality of electrical contact elements is disposed, this socket being shaped to permit the insertion of a plug-in adaptor which is electrically connected to the external device and comprises a plurality of electrical contact zones, each intended to come into contact with a corresponding electrical contact element in the socket. The electrical contact elements are disposed substantially perpendicularly to the direction of insertion of the plug-in adaptor, and the electrical contact zones extend substantially parallel to the direction of insertion of the plug-in adaptor. Also described is a system for recharging a battery of a portable electronic instrument comprising such a connection device, as well as a plug-in adaptor for such a connection device.

13 Claims, 4 Drawing Sheets

U.S. PATENT DOCUMENTS

| | | | | |
|---|---|---|---|---|
| 4,165,605 | A | 8/1979 | Kashio | |
| 4,323,996 | A * | 4/1982 | Ganter | 368/88 |
| 5,703,460 | A * | 12/1997 | Planells Almerich | 320/107 |
| 5,848,456 | A | 12/1998 | Sjöqvist | |
| 6,132,234 | A * | 10/2000 | Waidner et al. | 439/358 |
| 6,162,099 | A * | 12/2000 | Wu | 439/638 |
| 6,231,390 | B1 | 5/2001 | Chang | |
| 6,435,917 | B1 * | 8/2002 | McDonald et al. | 439/669 |
| 6,443,751 | B1 | 9/2002 | Pan | |
| 6,454,608 | B1 * | 9/2002 | Kitahara et al. | 439/638 |
| 2002/0145943 | A1 | 10/2002 | Tree | |

FOREIGN PATENT DOCUMENTS

| | | |
|---|---|---|
| JP | 2001-186584 | 7/2001 |
| WO | WO 96/28865 | 9/1996 |

* cited by examiner

DEVICE PLUG AND ELECTRONIC INSTRUMENT SOCKET PARTICULARLY FOR USE IN RECHARGING INSTRUMENT BATTERY

This is a National Phase Application in the United States of International Patent Application No. PCT/EP2004/050105 filed Feb. 10, 2004, which claims priority on European Patent Application No. EP 03003938.2 filed Feb. 21, 2003 The entire disclosures of the above patent applications are hereby incorporated by reference.

TECHNICAL FIELD

The present invention concerns generally devices which make it possible to establish an electrical connection between a portable electronic instrument, such as a wristwatch, and an external device by means of a plug-in electrical adaptor. The present invention relates more particularly to the use of such devices in order to allow the connection of a portable electronic instrument fitted with a rechargeable battery to an external battery charging device. The present invention applies also to any system requiring the establishment of an electrical connection with an external device in order to transmit and/or exchange data or electrical signals between the portable instrument and the external device.

BACKGROUND OF THE INVENTION

In the field of digital watches, a certain number of solutions which make it possible to establish an electrical connection between the watch and an external device are already known. Documents U.S. Pat. No. 4,118,922, U.S. Pat. No. 4,323,996, U.S. Pat. No. 4,103,483 and U.S. Pat. No. 4,165,605 describe for example a certain number of solutions which consist in placing one or more electrical contact elements in the bottom of the casing of the watch, in an area where the watch is in contact with the user's skin, the electrical connection with these contact elements being guaranteed by an adaptor or by suitable contact means.

The proximity of the electrical contact elements of the watch to the user's skin is an important constraint. It is indeed desirable, as a general rule, to avoid all contact of these elements with the user's skin. Mechanical or electrical means of protection must typically be provided in order to limit this risk. On the other hand, these solutions are subject to dirtying or contamination problems which impair the quality of the electrical connection.

More desirable solutions for tackling the problem of a possible contact with the user's skin have already been suggested. The document U.S. Pat. No. 5,703,460 describes for example an electrical connection device using a plug-in adaptor which is inserted into a socket provided laterally in the watch casing. Although it allows all contact with the user's skin to be avoided, this solution nonetheless has the disadvantage of only allowing the establishment of an electrical connection with a single contact element (an additional plug-in adaptor being necessary for the establishment of an electrical connection with a supplementary contact element in the watch) and of being more severely subject to contamination problems, dirt and impurities accumulating in the bottom of the socket as the watch is used. Moreover, the configuration of the connection device is not suitable from the viewpoint of guaranteeing the water resistance of the portable instrument.

Another solution using a plug-in adaptor is illustrated by the document JP 2001-186584. This document describes a portable electronic instrument taking the form of a wristwatch provided with a connection device ensuring an electrical link with a pair of headphones. The plugging-in of the pair of headphones is ensured by a conventional jack-type adaptor. In the context of this application, the adaptor has three electrical contact zones aligned the one behind the other in the direction of insertion of the adaptor into its socket. In the same way, this socket is provided with three electrical contact elements also aligned the one behind the other in the direction of insertion of the adaptor, these three contact elements being electrically linked to the electrical and electronic components housed in the casing of the instrument. It should be noted that the socket Into which the adaptor is to be plugged in is not as such arranged directly in the casing of the Instrument, but into an additional casing attached to the casing of the Instrument, the electrical connection between the two casings being ensured by components of a similar construction to that of a push-button.

This solution has the advantage of requiring only a single plug-in connector to establish a plurality of electrical connections, as well as constituting a relatively widespread standard on the market This solution Is however always Ill-adapted with regard to the sealing constraints of the portable Instrument and is also very sensitive to the build-up of dirt or impurities which may Impair the quality of the electrical contact. Moreover, the construction of such a device remains relatively complex and is not very robust in use.

SUMMARY OF THE INVENTION

The aim of the present invention is to propose a solution of simple and robust construction which is particularly adapted to the construction constraints of a portable electronic instrument Intended to be used in various environments where the accumulation of dirt and of impurities constitutes a problem.

The present invention has furthermore the aim of proposing a solution which allows the water resistance of the portable electronic instrument to be readily ensured.

A further aim of the present invention is to propose a solution which makes it possible to guarantee a high quality of electrical contact between the portable instrument and the plug-in adaptor.

Yet another aim of the present invention is to propose a solution which may be particularly suited for use within the framework of a battery recharging system The present invention has thus as its main object a device providing an electrical connection between a portable electronic instrument (1) and an external device, wherein the portable electronic instrument (1) comprises a casing (10) provided with a socket (15) in which at least first and second electrical contact elements (31, 32) are disposed, this socket (15) being shaped to permit the insertion of a plug-in adaptor (2) which is electrically connected to the external device and comprises at least first and second electrical contact zones (21, 22), each intended to come into contact with a corresponding electrical contact element (31, 32) in the socket (15), wherein the electrical contact elements (31, 32) are disposed substantially perpendicularly to the direction of insertion (A) of the plug-in adaptor (2), and wherein the first and second electrical contact zones (21, 22) extend side by side parallel to the direction of insertion (A) of the plug-in adaptor (2).

The present invention also has as object a battery recharging system for a portable electronic instrument using such an electrical connection device.

Finally the present invention also has as object a plug-in adaptor used in the framework of the above-mentioned electrical connection device.

Advantageous embodiments of the present invention are the subject of the dependent claims.

According to the proposed solution, the electrical contact elements arranged in the socket into which the plug-in adaptor is inserted are disposed substantially perpendicularly to the direction of insertion of the adaptor. The adaptor for its part comprises electrical contact zones each intended to come into contact with a corresponding electrical contact in the socket and extending side by side substantially parallel to the direction of insertion of the adaptor in the socket. It will be understood thus that the contact elements arranged in the socket and the corresponding contact zones provided on the adaptor do not face one another, but cooperate perpendicularly.

This respective arrangement of the electrical contact elements and the electrical contact zones has the advantage of great simplicity and great robustness in use. As will be seen in detail in the remainder of the description, the arrangement of the electrical contact elements in the portable instrument may very easily be achieved at the same time as ensuring an adequate water resistance of the instrument at this level.

Preferably, the arrangement of the contact elements and the contact zones in relation to one another is selected such that, during the insertion of the adaptor, the contact elements exert friction on the corresponding contact zone. In this way self-cleaning of the electrical contacts takes place facilitating a high quality of contact.

BRIEF DESCRIPTION OF THE DRAWINGS

Other features and advantages of the present invention will become more apparent by reading the detailed description which follows of a preferred embodiment of the invention given solely by way of non-restrictive example and illustrated by the annexed drawings in which.

EMBODIMENTS OF THE INVENTION

The Figures show one embodiment of a device for establishing an electrical connection between a portable electronic Instrument and an external device using a plug-in adaptor according to the invention. It will be understood that the invention is not limited to this single embodiment but may be applied to all types of portable electronic instrument, which may be in the form of a wrist-watch as illustrated or in the form of any other portable instrument (mobile telephone, pocket calculator, electronic organiser, personal digital assistant, etc.).

It will also be understood that the nature of the external device which is to be connected electrically to the portable electronic instrument has only little importance. It could be for instance, in accordance with what will be discussed below, a device for recharging the battery of the portable instrument or of any other device requiring an electrical link with the portable instrument. Thus, the plug-in adaptor could be used to connect a peripheral to the portable Instrument (for example a pair of headphones, an external interface for non-contact communication—RF-type, optical, inductive, . . . , etc.) or to connect the portable instrument to a computer terminal or another portable instrument. Generally speaking, the device for establishing electrical connection according to the invention may be used to pass electrical signals or data.

Figure 1:
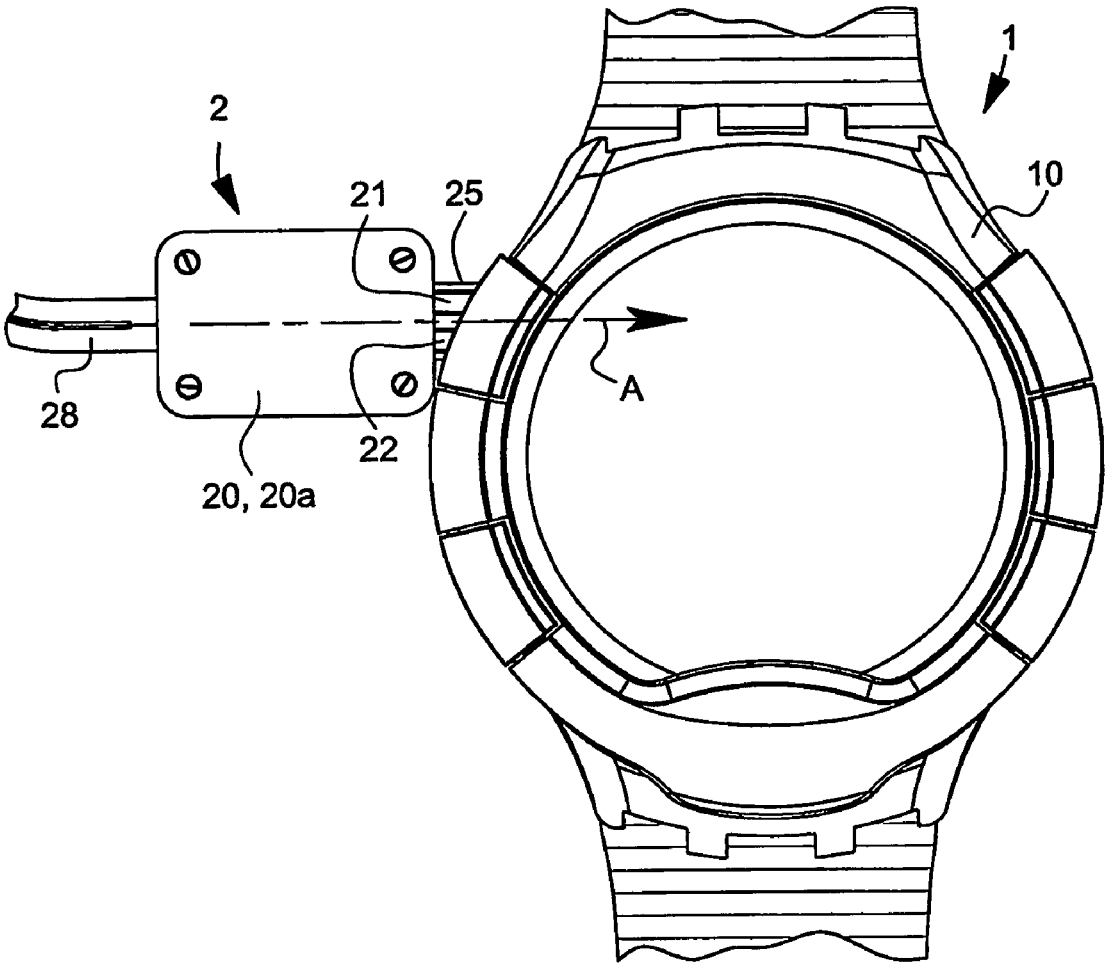
FIG. 1 shows a plan view of a portable electronic instrument in the form of a wrist-watch, as well as of a plug-in adaptor inserted In a socket of the portable instrument to ensure an electrical connection of this instrument with an external device not illustrated, this arrangement illustrating an embodiment of the present invention.
Figure 2:
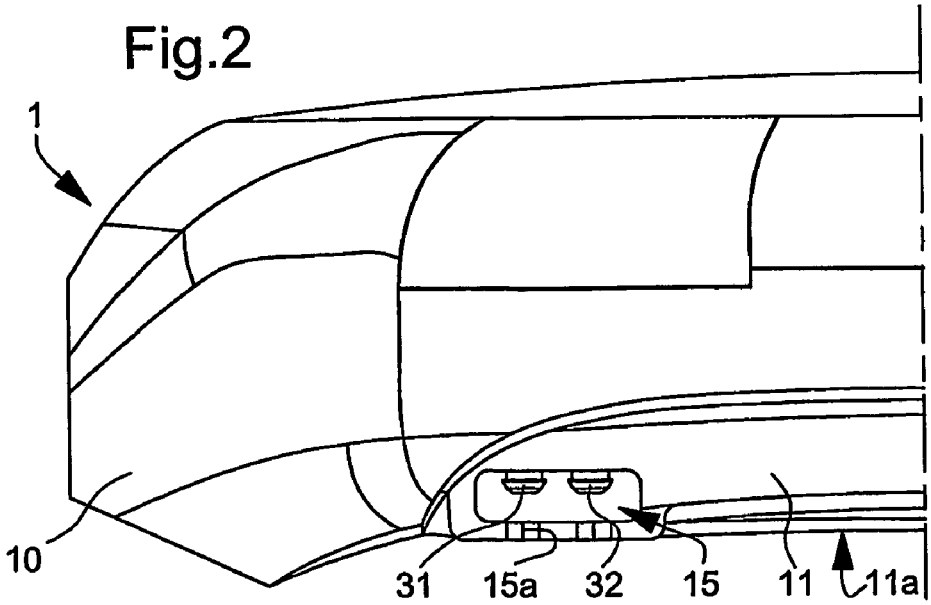
FIG. 2 is a partial view taken in the 9 o'clock position of the portable electronic instrument of FIG. 1 showing the socket intended to receive the plug-in adaptor, two electrical contact elements the ends of which are shown being arranged inside this socket.

FIG. 1 shows a plan view of a portable electronic instrument designated globally by the reference numeral 1 and taking the form of a wrist-watch, to which an external device (not illustrated) is linked by means of a plug-in adaptor, designated globally by the reference numeral 2, which is inserted in the direction A into a socket 15 of the portable instrument 1. As illustrated In FIG. 2, the socket 15 into which the plug-in adaptor 2 is inserted is provided in a part forming the bottom 11 of the casing 10 of the portable instrument 1.

In the example illustrated, two electrical contact elements 31, 32 emerge in the socket 15 (only the ends of the elements 31, 32 being visible on FIG. 2). These contact elements 31, 32 are intended to come into contact with the corresponding electrical contact zones, designated respectively 21 and 22, provided on an extension 25 of the adaptor 2. In this embodiment, contact elements 31, 32 are aligned in a plane which Is substantially perpendicular to the direction of insertion A of the plug-in adaptor 2. The contact elements 31, 32 could alternatively be offset with respect to the direction of insertion A.

According to the preferred embodiment illustrated in FIGS. 1 and 2, it will be noted that the portable electronic instrument I is adapted to be worn in contact with the user's skin (in this case in contact with the wrist), the lower face 11 a of the bottom 11 of the portable instrument thus constituting an area of contact with the skin. Because of the proximity of the skin, the socket 15 is preferably provided in the bottom 11 recessed with respect to the zone of contact 11*a* of this bottom with the user's skin. On the other hand, the electrical contact elements 31, 32 extend into the socket 15 in the direction of the contact zone 11*a* but without being able to come into contact with the user's skin.

Figure 3A:
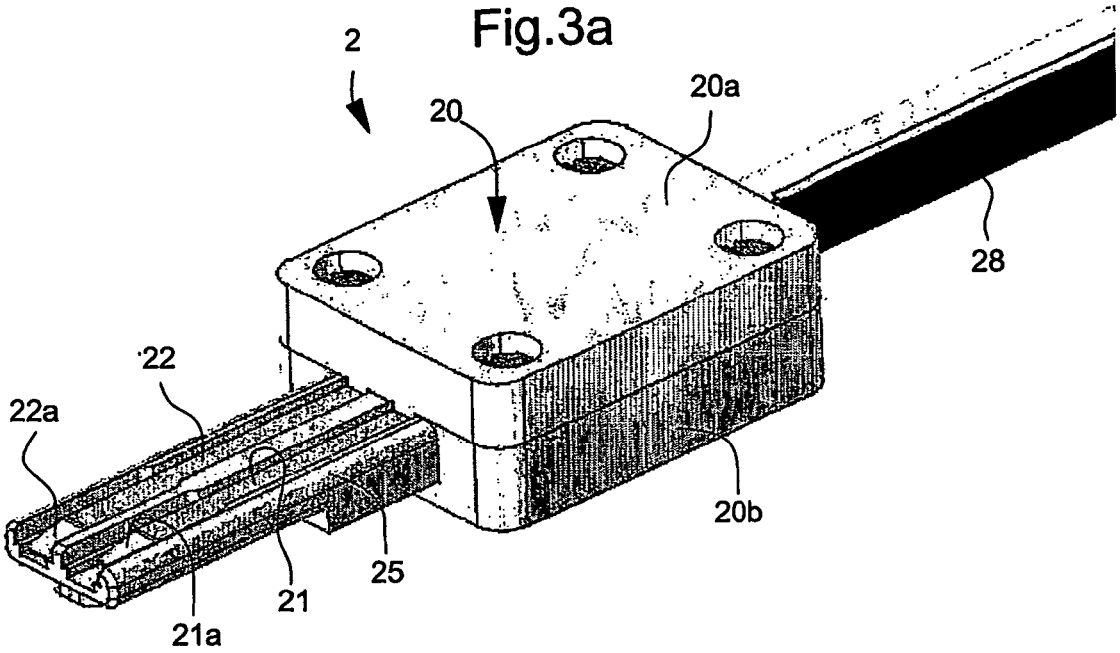
FIGS. 3*a* and 3*b* are perspective views, respectively of the upper and lower sides, of the plug-in adaptor of FIG. 1.
Figure 3B:
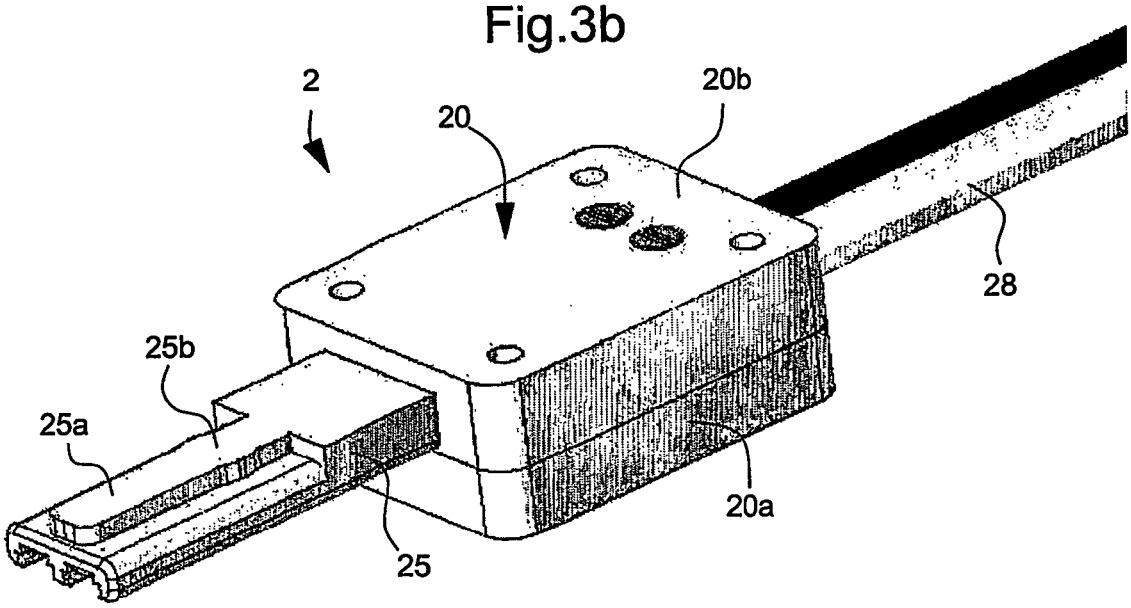

FIGS. 3*a* and 3*b* illustrate in greater detail the structure of the plug-in adaptor 2. The latter consists essentially of a body 20, constructed here of two assembled portions 20*a* and 20*b*, and of an extension 25 disappearing for the most part in the socket 15 after insertion in the portable instrument 1. The body 20 is linked to the external device, not illustrated, by means of a cable comprising two conductors in this example. On this account, it will be understood that the number of contact elements, of contact zones and of conductors obviously depends on the nature of the external device and/or on the nature of the electrical signals to be transmitted. As an example of application, the adaptor 2 is here used to connect the portable instrument 1 to an external device for recharging batteries and requires in this case a pair of connection lines to connect the portable instrument 1 and its battery, not illustrated, to the recharging system. Alternatively, more than two connection lines might be provided.

The electrical contact zones 21, 22 take the form of a pair of conducting tongues arranged side by side substantially in the same plane. A portion of these conducting tongues is exposed on the upper face of the extension 25, that is to say the face of extension 25 which is directed towards the electrical contact elements 31, 32 during the Insertion of the plug-in adaptor 2 into the socket 15 of the portable instrument 1.

The other face of extension 25 (the lower face) has a rib 25*a* intended to cooperate with a corresponding opening 15*a* in the wall of the socket 15. This lateral opening 15*a* is more clearly visible in FIGS. 4 to 6. The rib 25*a* includes moreover a protuberance, designated 25*b*, which plays a part in the mechanical locking of the adaptor 2 in the socket 15 of the portable Instrument, as will be seen in more detail with reference to FIG. 6.

Figure 4:
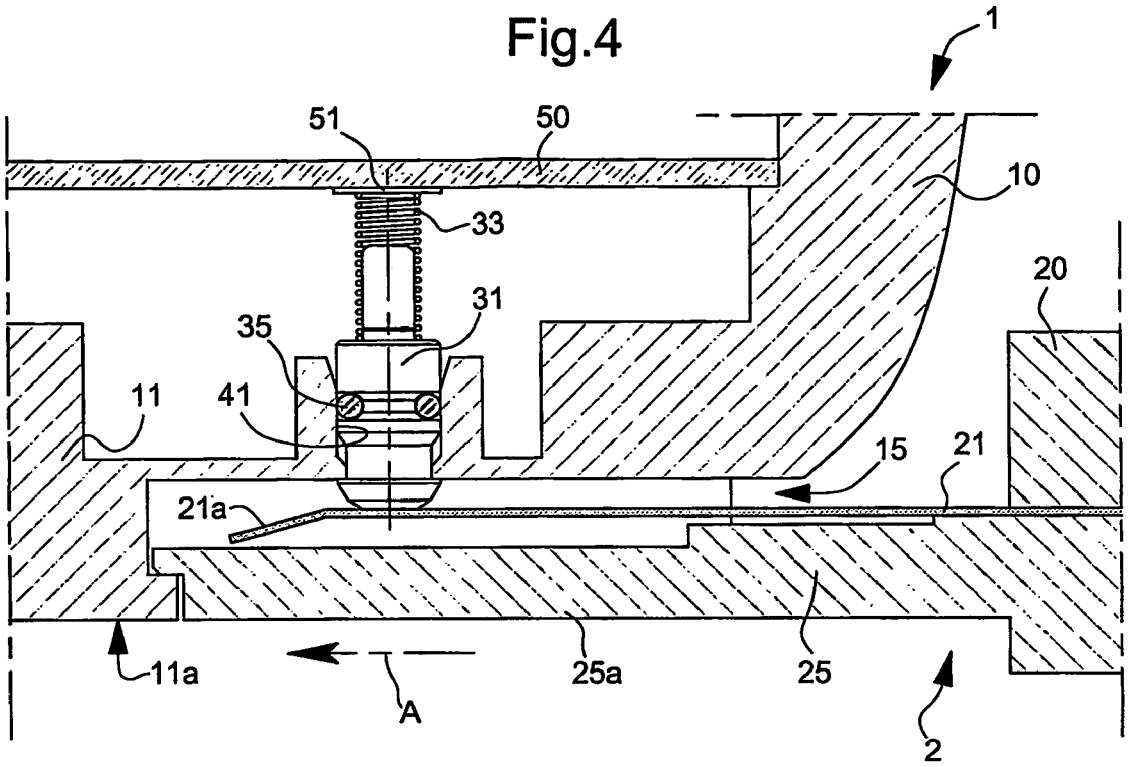
FIG. 4 is a partial sectional view of the portable instrument and of the plug-in adaptor of FIG. 1 taken on a cutting plane parallel to the direction of insertion of the plug-in adaptor and passing through one of the electrical contact elements illustrated in FIG. 2.
Figure 5:
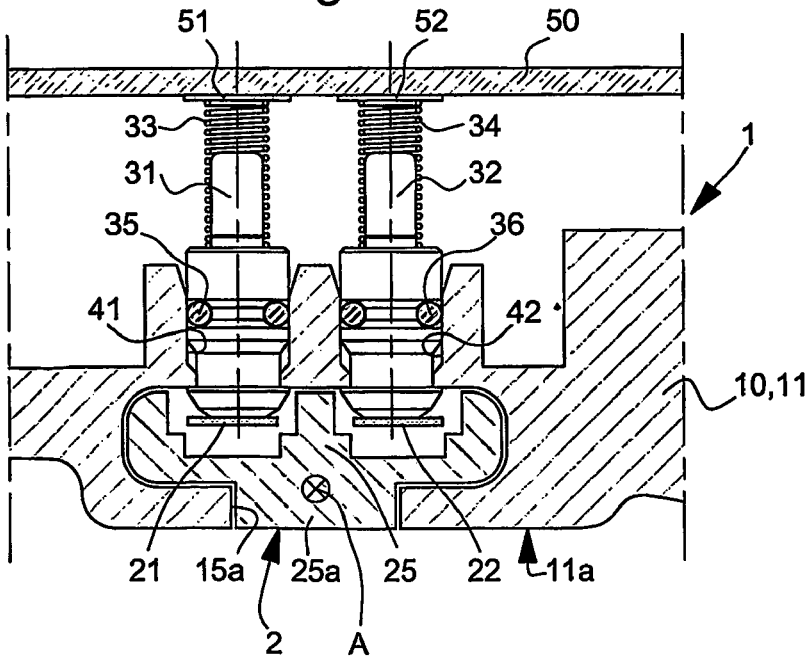
FIG. 5 is a partial sectional view of the portable Instrument and of the plug-in adaptor of FIG. 1 taken on a cutting plane perpendicular to the direction of insertion of the plug-in adaptor and passing through the electrical contact elements represented in FIG. 2.

FIGS. 4 and 5 illustrate more clearly the manner in which the adaptor 2 Is arranged after insertion into the socket 15 of the portable Instrument as well as the manner In which the contact elements 31, 32 and the contact zones 21, 22 cooperate. FIG. 4 is a partial sectional view of the portable Instrument 1 and of the adaptor 2 along a cutting plane parallel to the direction of Insertion A of the adaptor 2, and passing through the contact element 31. FIG. 5 is a partial sectional view of the portable instrument 1 and of the adaptor 2 along a cutting plane perpendicular to the direction of Insertion A and passing through the contact elements 31 and 32.

As can be seen in greater detail in FIGS. 4 and 5, each contact element 31, 32 takes the form of a moveable conductive stem (similar in configuration to the stem of a push-button) mounted vertically, top towards the bottom, in the bottom 11 of the casing 10. Each contact element 31, 32 is thus mounted in a corresponding opening 41, 42 provided in the bottom 11 and opening into the upper wall of the socket 15. It should be noted that each contact element 31, 32 is held in its opening 41, 42 by means of a collar provided at the base of its head and which is able to come to rest, as illustrated in FIGS. 4 and 5, on a narrowing in the opening. This narrowing thus ensures the retention of each contact element. It is noted that this narrowing is configured so as to deform in a resilient manner during mounting of the contact elements 31, 32 in casing 10.

The water resistance of the portable Instrument 1, at the level of the socket 15 and of the openings 41, 42 is ensured by a pair of O-ring joints 35, 36 arranged in a groove provided on the contact elements 31, 32.

It will be noted also that each contact element 31, 32 is firmly attached to a spring element 33, 34 respectively, which conditions their axial displacement These spring elements 33 and 34 are placed between the contact elements 31, 32 and a printed circuit board (hereinafter referred to as PCB) 50 bearing two contact areas 51, 52 connected electrically to the spring elements 33, 34. This PCB 50 rests for its part in the casing 10 of the portable instrument as Illustrated in FIG. 4.

In the rest position, as illustrated partially in FIG. 2, the spring elements 33 and 34 cause a slight vertical displacement of the contact elements 31, 32 towards the bottom. During insertion of the plug-in adaptor 2, the contact elements 31 and 32 are pushed upwards in the direction of PCB 50, compressing the spring elements 33 and 34, under the effect of the conducting tongues 21, 22. As illustrated in FIGS. 3*a* and 4, the ends 21 a and 22a of the conducting tongues 21, 22 are curved downwards to facilitate the insertion of the tongues and to avoid becoming jammed.

In the light of FIGS. 4 and 5, it will be understood that during the insertion of the plug-in adaptor 2 into the socket 15, each contact element 31, 32 will exert friction on the corresponding electrical contact zone 21, 22. This friction is preferable from the point of view of the quality of electrical contact because it ensures self-cleaning of the contact region.

As has already been mentioned above, according to the preferred embodiment, the socket 15 has, besides its front opening allowing the insertion of the plug-in adaptor 2, a lateral opening 15*a* in the lower wall of the socket 15. This opening 15*a* facilitates, on the one hand, cleaning of the ends of the contact elements 31 and 32, the latter being partially accessible through this opening 15*a*. On the other hand, as illustrated in FIGS. 4 and 5 (as well as in FIG. 6), the lateral opening 15*a* receives the rib 25*a* formed on the extension 25 of the adaptor 2 and thus plays the role of a foolproof mechanism, that is to say a mechanism for ensuring that the adaptor 2 can only be Inserted Into the socket 15 in a single manner as will be understood readily from the illustration of FIG. 5.

Figure 6:
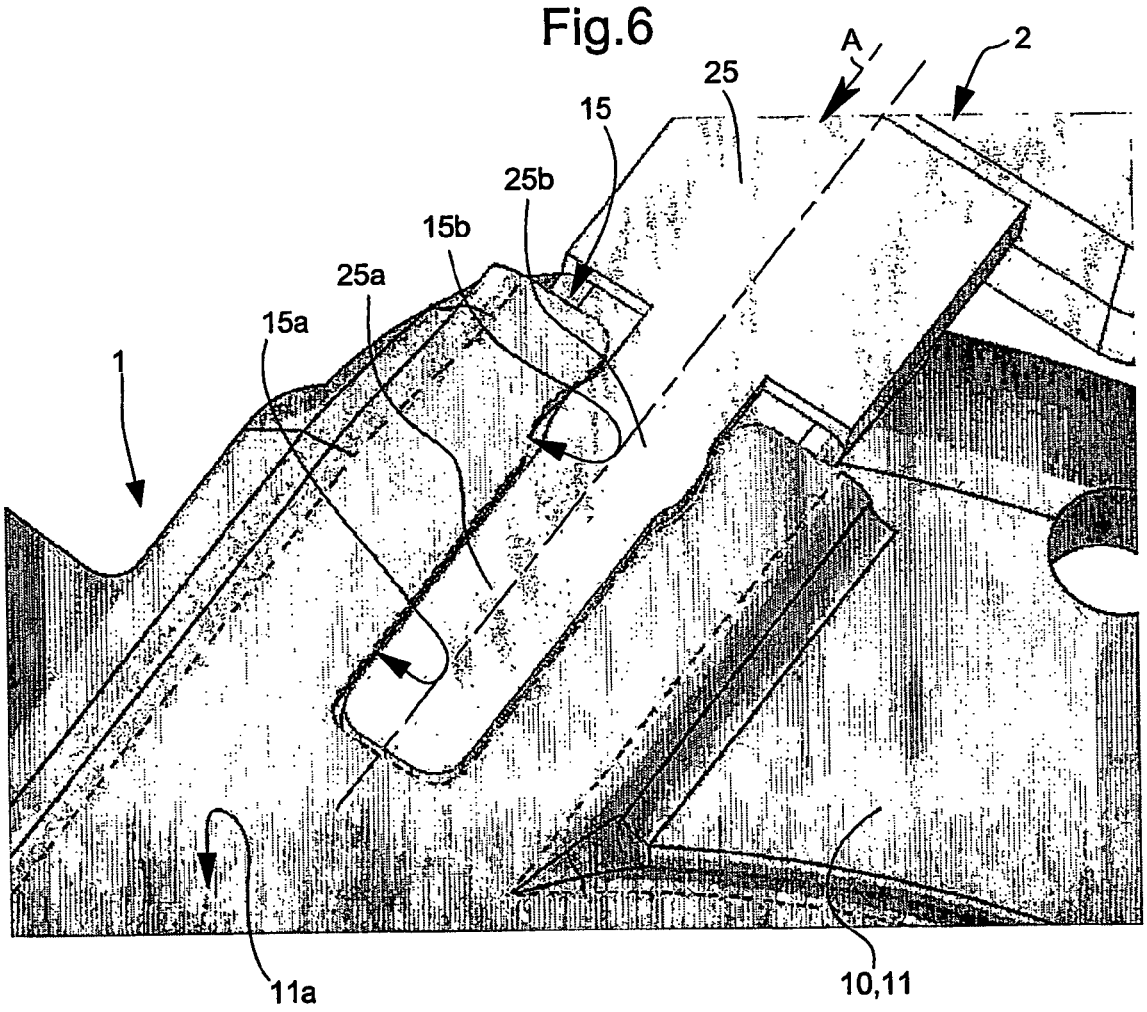
FIG. 6 is a perspective view of the lower face of the portable electronic instrument, with the plug-in adaptor mounted, illustrating a snap-lock mechanism of the adaptor in the socket of the portable instrument.

By preference, as has already been mentioned and illustrated in FIG. 6, the rib 25*a* on the adaptor 2 is also provided with a protuberance 25b which is intended to retain the adaptor 2 mechanically in the socket 15 once inserted. The opening 15*a* has therefore an enlargement 15*b* to receive this protuberance 25*b*. It will have been understood that the rib 25*a*, the protuberance 25*b*, the opening 15*a* and the enlargement 15*b* cooperate to form a snap-lock mechanism for the adaptor 2 in the socket 15. It will also be understood that other snap-lock mechanisms could be envisaged, the adaptor 2 being able, for example, to be locked in the socket by means of a mechanism placed on the front portion of the socket 15. In the same way, the foolproof function of the opening 15*a* and of the rib 25*a* could be achieved differently, for example, by means of a rib formed on one of the lateral portions of the extension 25 and of a corresponding groove in one of the lateral walls (vertical walls in FIG. 5) of the socket 15. It will be noted nevertheless that the lateral opening 15*a* is preferable however, as already mentioned, in order to facilitate cleaning of the ends of the contact elements 31 and 32.

By way of advantageous modification, it may be wise to provide the bottom of the socket 15 with a switching mechanism permitting the electrical uncoupling of the contact elements 31 and 32 from the electrical and/or electronic components to which they ought to be linked when the plug-in adaptor 2 is not inserted. This switching mechanism may, as far as its mechanical and electrical parts are concerned, take the form of a push-button, the axial displacement of which would be initiated by the end portion of the extension 25 and which, once displaced by the presence of the adaptor 2, would lead to the closing of an electrical circuit interposed between the contact elements 31 and 32 and the associated electrical and/or electronic components.

By way of supplementary modification, the provision of a mechanism to vertically displace the contact elements 31, 32 only after the insertion of the adaptor 2 could be easily envisaged. This could be effected by means of a cam mechanism similar to that which is encountered in crown-stem mechanisms in order to follow their axial displacement, the displacement of the cam being produced mechanically by the presence of the adaptor 2 in the socket 15. According to this modification, it will be understood that the contact elements 31, 32 could be arranged in such a way that they do not necessarily exert friction on the contact zones 21, 22 of the adaptor. This friction remains nonetheless preferable from the point of view of guaranteeing the good quality of the electrical contact It will be generally understood that various modifications and/or obvious improvements for the person skilled in the art can be made to the embodiment described in the present description without departing from the framework of the invention defined by the annexed claims. In particular, the present invention is not limited solely to a use in a wristwatch and is obviously not limited to a connection device employing only two electrical connection lines.

One modification could for instance consist in providing the plug-in adaptor with additional contact zones and providing the socket with additional contact elements. In particular, the plug-in adaptor might be provided with four distinct contact zones (for example through the provision of four conductive tongues on the upper and/or lower part of the plug-in adaptor) arranged in any suitable manner so as to respectively contact four electrical contact elements disposed in the socket. In this case, two contacts could be used to perform a recharging operation while the other two could be used to exchange data. The four contact zones could either be arranged side by side on the plug-in adaptor or could be arranged by pairs in two separate planes so that the plug-in adaptor can be constructed as a more compact unit. Similarly, the four contact elements could be aligned in a same plane (as this is the case for contact elements 31, 32 in the FIGURES) or be arranged in a 2×2 configuration in two separate planes. Additional contact zones might also be arranged laterally on each side of the adaptor and corresponding contact elements be provided in the casing with a horizontal orientation.

The invention claimed is:

1. Device for establishing an electrical connection between a portable electronic instrument and an external device, said portable electronic instrument comprising a casing provided with a socket in which at least first and second electrical contact elements are disposed, this socket being shaped to permit insertion of a plug-in adaptor which is electrically connected to said external device and comprises at least first and second electrical contact zones, each intended to come into contact with a corresponding electrical contact element in said socket, wherein said electrical contact elements are disposed substantially perpendicularly to the direction of insertion of said plug-in adaptor, and wherein said first and second electrical contact zones extend side by side parallel to the direction of insertion of the plug-in adaptor, and wherein each contact element takes the form of a moveable conductive stem mounted in said casing and each conductive stem is essentially cylindrically shaped.

2. Device according to claim 1, wherein each electrical contact element is adapted to exert friction on the corresponding electrical contact zone during the insertion of said plug-in adaptor.

3. Device according to claim 1, wherein said plug-in adaptor includes an extension which substantially disappears into said socket after insertion into the portable electronic instrument, and wherein said first and second electrical contact zones are formed as first and second conducting tongues disposed substantially in a same plane and of which at least portions are exposed on one face of said extension of the plug-in adaptor, the exposed portions of said conducting tongues being oriented towards said electrical contact elements when the plug-in adaptor is inserted in the socket of the portable electronic instrument.

4. Device according to claim 1, wherein said portable electronic instrument is adapted to be carried on the wrist of a user and wherein said casing has a bottom having a zone of contact with the user's skin, said socket being provided in the bottom of the portable electronic instrument and recessed relative to the zone of contact of this bottom with the user's skin.

5. Device according to claim 4, wherein said electrical contact elements extend in said socket in the direction of said zone of contact of the bottom with the user's skin, but without being able to come into contact with the user's skin.

6. Device according to claim 1, further including a snap-lock mechanism for locking said plug-in adaptor in said socket.

7. System for recharging a battery of a portable electronic instrument by means of an external charging device, wherein said external charging device is connected to said portable electronic instrument by means of an electrical connection device according to claim 1.

8. Device according to claim 1, wherein each electrical contact element is provided with a groove formed therein and an O-ring joint disposed in said groove.

9. Plug-in adaptor for establishing an electrical connection with a portable electronic instrument comprising a casing provided with a socket in which at least first and second electrical contact elements are disposed, this plug-in adaptor comprising at least first and second electrical contact zones, each intended to come into contact with a corresponding electrical contact element in said socket, said electrical contact zones being configured to come into contact perpendicularly to said electrical contact elements, wherein said first and second electrical contact zones extend side by side substantially parallel to the direction of insertion of the plug-in adaptor in said socket, and wherein each contact element takes the form of a moveable conductive stem mounted in said casing and each conductive stem is essentially cylindrically shaped.

10. Adaptor according to claim 9, further including an extension which is intended to disappear substantially into said socket after insertion into the portable electronic instrument, and wherein said first and second electrical contact zones are formed as first and second conducting tongues disposed substantially in the same plane and of which at least portions are exposed on one face of said extension of the plug-in adaptor, the exposed portions of said conducting tongues being oriented towards said electrical contact elements when said plug-in adaptor is inserted in the socket of the portable electronic instrument.

11. Device according to claim 9, wherein each electrical contact element is provided with a groove formed therein and an O-ring joint disposed in said groove.

12. Device for establishing an electrical connection between a portable electronic instrument and an external device, the portable electronic instrument comprising a casing provided with a socket in which at least first and second electrical contact elements are disposed, this socket being shaped to permit insertion of a plug-in adaptor which is electrically connected to the external device and comprises at least first and second electrical contact zones, each electrical zone intended to come into contact with a corresponding electrical contact element in the socket, wherein the electrical contact elements are disposed substantially perpendicularly to the direction of insertion of the plug-in adaptor, and wherein the first and second electrical contact zones extend side by side parallel to the direction of insertion of the plug-in adaptor, and wherein the socket has, in addition to an opening permitting the insertion of the plug-in adaptor, a lateral opening relative to the direction of insertion of the plug-in adaptor to facilitate cleaning of the electrical contact elements disposed in the socket.

13. Device for establishing an electrical connection between a portable electronic instrument and an external device, the portable electronic instrument comprising a casing provided with a socket in which at least first and second electrical contact elements are disposed, this socket being shaped to permit insertion of a plug-in adaptor which is electrically connected to the external device and comprises at least first and second electrical contact zones, each electrical zone intended to come into contact with a corresponding electrical contact element in the socket, wherein the electrical contact elements are disposed substantially perpendicularly to the direction of insertion of the plug-in adaptor, and wherein the first and second electrical contact zones extend side by side parallel to the direction of insertion of the plug-in adaptor, and wherein the socket has, in addition to an opening permitting the insertion of the plug-in adaptor, a lateral opening relative to the direction of insertion of the plug-in adaptor to facilitate cleaning of the electrical contact elements disposed in the socket, and the lateral opening forms an integral part of a snap-lock mechanism for locking the plug-in adaptor in the socket.

* * * * *